United States Patent [19]

Kerschner et al.

[11] Patent Number: 4,570,287

[45] Date of Patent: Feb. 18, 1986

[54] METHOD OF AND APPARATUS FOR PICKING UP REFUSE FROM A SURFACE, SUCH AS A TRACK BED

[75] Inventors: Engelbert Kerschner, Leichlingen; Edgar Muschelknautz, Leverkusen, both of Fed. Rep. of Germany

[73] Assignee: Walter Schneider GmbH & Co. KG, Witzhelden, Fed. Rep. of Germany

[21] Appl. No.: 613,601

[22] Filed: May 23, 1984

[30] Foreign Application Priority Data

May 24, 1983 [DE] Fed. Rep. of Germany ..... 3318756

[51] Int. Cl.[4] ..... E01H 1/08

[52] U.S. Cl. ..... 15/346; 15/340

[58] Field of Search ..... 15/340, 345, 346

[56] References Cited

U.S. PATENT DOCUMENTS

| | | | |
|---|---|---|---|
| 1,704,043 | 3/1929 | Green | 15/346 |
| 2,932,845 | 4/1960 | Rydberg | 15/346 |
| 3,075,227 | 1/1963 | Bowles | 15/346 |
| 3,959,010 | 5/1976 | Thompson et al. | 15/353 X |
| 3,963,515 | 6/1976 | Haldeman et al. | 15/345 X |
| 4,457,043 | 7/1984 | Oeberg et al. | 15/346 X |

FOREIGN PATENT DOCUMENTS

| | | | |
|---|---|---|---|
| 610511 | 6/1978 | U.S.S.R. | 15/346 |

*Primary Examiner*—Chris K. Moore

*Attorney, Agent, or Firm*—Toren, McGeady, Stanger, Goldberg & Kiel

[57] ABSTRACT

To clean the ballast bed of a railroad track, a wheeled vehicle movable over the ballast bed contains a blower for generating a positive flow of air and a suction flow. A suction port is located on the vehicle spaced a given distance above the ballast bed. A pipe section outlet is located around the suction port. The positive flow of air is directed through the pipe section outlet so that it provides a circular air flow about the downward projection of the suction port. The circular air flow sweeps the surface of the ballast bed and any refuse swept up is drawn into the suction port by the suction flow generated by the blower.

21 Claims, 8 Drawing Figures

METHOD OF AND APPARATUS FOR PICKING UP REFUSE FROM A SURFACE, SUCH AS A TRACK BED

SUMMARY OF THE INVENTION

The present invention is directed to a method of and apparatus for picking up refuse from a surface, such as the ballast bed of a railroad track, by directing a flow of air from a vehicle moving over the surface and drawing the air flow into the vehicle.

For a long time it has been known to pick up refuse from a road surface, including dust and dirt particles, by using a flow of air generally developed by a suction nozzle generating the highest possible air flow over the road surface. As a rule, a so-called sweeping roller is combined with the suction nozzle to loosen the dust and dirt particles from the road surface to facilitate their pick-up by the suction action. To afford the best possible efficiency, among other things, the distance of the suction nozzle from the road surface must be kept as small as possible and the area being suctioned must be enclosed by means of aprons or the like.

To facilitate picking up such refuse, it has been known, further, to provide a positive flow of air to the suction flow in a box-like picking up mechanism or to provide nozzles providing a positive flow behind the openings of the so-called suction port with the nozzles being supplied from a portion of the exhaust air of the vacuum member generating the suction air flow. The suction region must be blocked off to prevent refuse particles from being blown out of the picking up apparatus or away from the suction port. It has been found, however, that unless an effective blocking or closure of the suction region is provided that, particularly in dry weather, the positive flow of air which contains dust is passed out of the picking up apparatus. This problem is especially noted when the picking up operation is carried out on uneven surfaces, such as paved roads with curbs, since air gaps,which allow the leakage of the positive flow of air, occur beneath the closure members around the suction region, such as where the roads are paved with stones.

Such equipment, as disclosed in U.S. Pat. No. 514,618 and the German Offenlegungsschrift No. 28 21 027 are not effective in practice.

An attempt has been made to produce the desired effect employing blowing nozzles by utilizing a special shape for the suction nozzle. In addition, it is known that the plane of the suction port opening which forms an acute angle with the surface to be cleaned, faces in the driving direction and the air conducting means, which extends approximately parallel to the surface to be cleaned and faces in the driving direction, is located in the plane of the opening. In addition, the suction port has an approximately rectangular cross-section and includes a front wall, a rear wall and two side walls with the air conducting means arranged at the rear wall of the suction port. Tilting of the suction port opening and, accordingly, movement of the direction of the suction air flow relative to the surface being cleaned is achieved by the inclination of the duct forming the suction port. Such movement changes the suction flow at the opening. The direction of the radial centrifugal forces produced by the flowing air, which centrifugal forces act on the refuse particles, no longer extend parallel to the surface to be cleaned. Rather, the forces are directed against the surface to be cleaned in the region of the rear wall of the suction duct at a certain angle, so that the refuse particles thrown in the same direction will rebound again from the surface to be cleaned and will enter the suction port. Accordingly, the partial air flow will be directed through the air conducting means, note German Gebrauchmuster No. 74 32 873.

Beside the fact that the construction of the suction nozzle presupposes the presence of a sweeping roller which loosens dirt and dust from the surface to be cleaned, the ballast beds of railroad tracks cannot be cleaned with such apparatus, since the tracks, the ties, the attachments between the ties and the tracks, the ballast, and in addition the power supply rails, cause different levels with respect to the cross-section of the track, and the sweeping rollers exert an undesirable influence on the ballast. Moreover, it is not possible to afford a sealing closure for the suction nozzle in the same manner that can be achieved with the street sweeping machine mentioned above.

To provide height compensation for the picking up apparatus mounted on a vehicle for cleaning ballast beds, it is known in German Patentschrift No. 22 17 975 to combine several suction nozzles arranged adjacent to one another with a dirt collecting vessel located on a vehicle mounting suction nozzles where several adjacent pairs of air guide elements are provided at the opening from each suction nozzle and these elements are automatically adjustable in height independently of one another. Accordingly, the air guide openings of each pair are supported at both sides of the suction nozzle opening and are coupled together for affording common upward and downward movement. To adjust the air guide elements to the level of the ballast bed, actuating cylinders are provided operated by pressure means and they are suspended on a carrying frame by articulated joints so that it is ensured as one of the elements moves forward or backward, the other element will execute the exact same movement. The adaptation of all air guide elements to the same condition of the track can be performed directly by direct contact or indirectly by a sensor control, that is, by sensing the height with supersonic devices in connection with an actuating device connected downstream and acted upon by the pressure means.

Despite the relatively high costs of such apparatus, it has been found that it cannot satisfactorily clean ballast beds of railroad tracks. This is particularly true in the region of railroad stations, where refuse of all kinds, such as cigarette and cigar butts, paper wrappers, paper, empty beverage containers and the like, are thrown onto the tracks. Even an increase in the suction action cannot solve this problem, since with such an increase there is a considerable risk that individual pieces of ballast may be sucked up, which is not only undesirable but may result in damage to filters and/or cyclone separators located downstream in the path of the suction flow. Further, suggestions such as filling the ballast beds to the level of the ties, or sealing the ballast bed by means of a pourable compound are either not applicable or do not afford a practical solution. Therefore, to keep the station areas along a railroad track free of refuse, personnel must be employed to spear cigarette butts, paper and similar wastes using a so-called nail stick so that the materials can be transferred manually to a collecting vessel. In addition, larger materials and cans must be gathered by hand and disposed in collecting vessels.

Therefore, it is the primary object of the present invention to provide a new method of and apparatus for picking up refuse from the ballast beds of railroad tracks by utilizing a positive air flow and a suction air flow so that cigarette butts, wrappers and the like as well as any other refuse on the ballast beds can be picked up in a fast and effective manner by means of the combined air flow, without any additional auxiliary means, such as sweeping rollers or ballast bed seals.

In accordance with the present invention, the refuse is guided from the ballast bed in a circular path travelling inwardly in the path and at the center of the path it is drawn upwardly through the suction port into the collecting vessel in the vehicle. The positive flow of air directed around the downward projection of the suction port is augmented by an air flow drawn inwardly from the surrounding atmosphere.

Advantageously, the circular whirling flow of air is provided by a rapidly circulating air flow amounting to about 20 to 50%, and preferably 30 to 40% of the total air quantity and this flow is preferably recirculated from the collecting vessel in the vehicle.

While taking into account the relative width or gauge of the track, several whirling circular paths of flow may be used. The refuse is drawn upwardly from each of these whirling flow paths and a feature of such an arrangement is that the air in the adjacent flow paths circulates in such a way that the whirling action flows in the same direction at the points of contact of the adjacent flow paths.

In one embodiment of the present invention, the apparatus for picking up refuse has at least one centrally located suction nozzle and at least one annular or circular wall nozzle disposed around the suction nozzle. The openings from the suction nozzle and the whirl nozzle are located in a plane positioned at a predetermined distance from the surface being cleaned. Further, the suction nozzle is connected with a duct providing the suction action while the whirl nozzle is provided with a duct providing a positive flow of air.

In another embodiment of the invention for increasing the effective range of the apparatus, a combination is provided of several suction nozzle-whirling nozzle members arranged adjacent to one another and enclosed within a common housing affording a gap-like suction port at the bottom. The housing is arranged at a distance from the suction nozzles and is connected in an articulated manner in the driving direction with the vehicle incorporating the picking-up apparatus.

In a preferred embodiment of the invention, the positive flow of air is supplied by controlled flaps or valve members to the location of the suction port. The supply of air is provided by a vacuum generator preferably in the form of a fan or blower.

As a result of the positive flow of air travelling in a circular path around the downward projection of the suction port and inwardly toward the projection of the suction port, it is possible to establish a significantly greater distance between the suction port opening and the level of the surface being cleaned than had been possible in the past. This feature of the air flow can be effected without reducing the ability to pick up refuse from the surface being cleaned. Accordingly, the positive supply of air directed around the downward projection of the suction port rotates slowly at first and then increases its speed as it moves in the inward direction. This positive flow of air encircling the downward projection of the suction port whirls up refuse and dirt particles from the suction being cleaned and directs them in the inward direction of the center of the whirling path where they are drawn upwardly by the suction action effective through the suction port. The annular air seal or curtain generated by the circular flow of air is relatively stable and, in addition, stimulates the ground current which acts in support of the suction action. Thus, the compact whirling flow is developed similar to a so-called whirlwind and causes extremely effective pick-up of refuse for passage into the suction port. The refuse and dirt particles cannot be blown outwardly from the region of the suction port. Moreover, aprons or other box-like enclosures for the picking-up apparatus is no longer necessary. The advantages of this circular or whirling air flow and suction flow are particularly notable if the surface to be cleaned is a railroad ballast bed. The make-up of a ballast bed is such that it does not permit a tight enclosure of the region in which the suction action takes place relative to the surrounding atmosphere. The whirling action of the air flow is particularly effective in picking up cigarette butts, wrappers and similar material which may be held in a clamp-like manner by the individual pieces of ballast Surprisingly, it has been found that for 100 cigarette butts present in a ballast bed in a railroad station area, more than 90 of the cigarette butts can be effectively picked up.

A reciprocal disturbance of the circulating air flow in adjacent positive flow-suction flow nozzle combinations is prevented from forming an elongated flat nozzle by directing the flow of the air in adjacent paths so that two adjacent air flow paths rotate in the same direction.

Surprisingly, the whirling and suction action is maintained when a rail is located transversly and forms an obstacle in the circularly circulating air flow, as long as the positive air stream flows in a ring-like manner which is not substantially disturbed by the obstacle. It appears that the suction action is deformed to the opposite sides of the rail obstacle into partly lying, partly standing whirling rollers which perform the same cleaning action with a slightly reduced mass flow.

The method and apparatus embodying the present invention do not depend on whether the suction air is produced in the so-called circulating flow or in the so-called vacuum or suction flow. With the suction action guided in the circulating flow, a particularly simple exhaust air cleaning results by means of cyclone separators. In the apparatus embodying the present invention, with the suction action guided within the circulating positive flow, and with the positive flow being diverted from the member providing the suction action, a particularly suitable arrangement is provided for railroad vehicles, that is, vehicles which can be used both on regular roads and on railroads.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
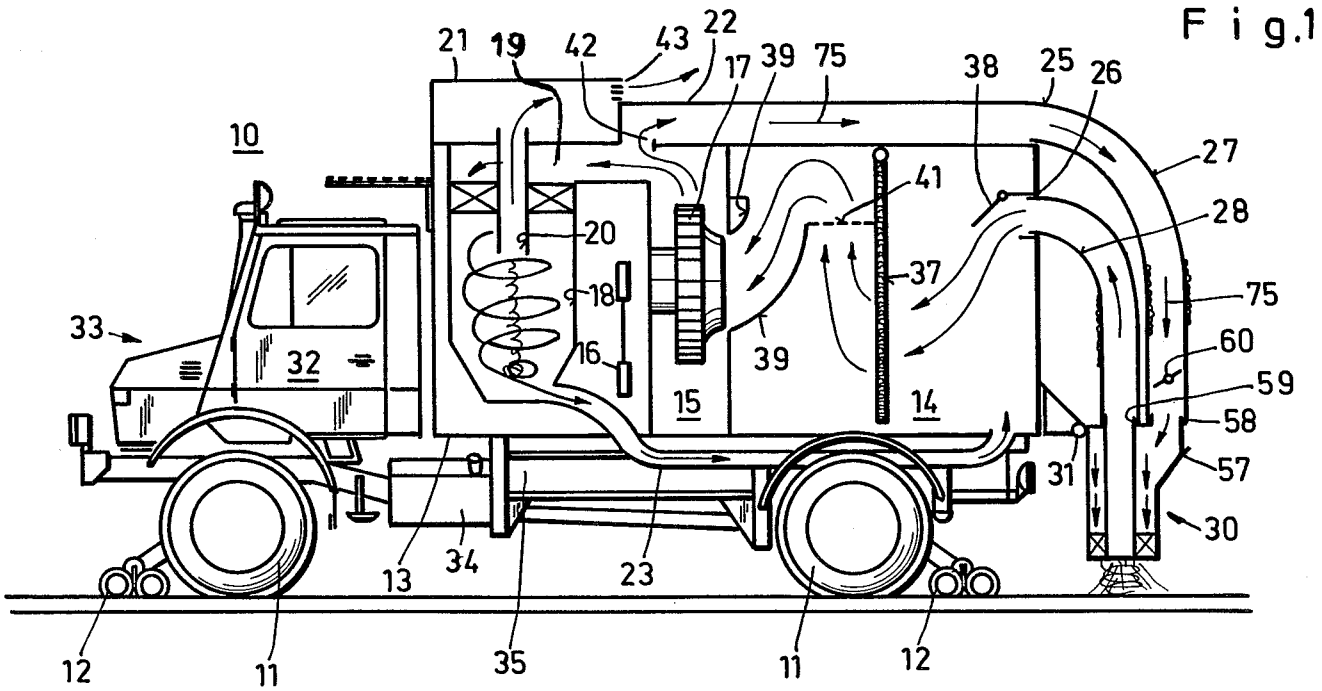
FIG. 1 is a schematic showing of a vehicle, partly in section, for use on a road or a railroad and incorporating apparatus for picking up refuse and dirt by a directed flow of air.

In FIG. 1 a vehicle 10 is shown suitable for operation over a conventional road or on a railroad. The vehicle has wheels 11 equipped with pneumatic tires for use in normal roadway traffic and track rollers 12 which can be lifted and lowered as required. A body 13 is mounted on the vehicle chassis and it is arranged for picking up refuse and dirt and includes a collecting vessel 14 located at the rear end of the body for receiving the picked up refuse and dirt. Within the body ahead of the vessel 14 is a blower space 15 containing a blower 17 driven by a gear unit 16 of the drive motor for the vehicle 10. Ahead of the blower space 15 within the body 13 is a cyclone separator 18 and the body also includes a number of air ducts 19,20,21,22 and 23. Extending from the rear end of the body 13 are two connection openings 25,26 to each of which a movably supported tube 27,28 is connected. The tubes 27,28 extend downwardly from the openings 25,26. The tubes 27,28 may be formed of metal, metal-reinforced rubber or plastics material. The tubes 27,28 extend downwardly to a picking-up device 30 which will be described below and in the most simple case is in the form of a so-called whirling flow-suction flow head supported by a bearing 31 from the trailing end of the body 13.

For the sake of completeness, the vehicle includes a driver's cab 32, a drive motor 33 and a fuel tank 34 all mounted on the chassis 35 which supports the body 13.

The collecting vessel 14 is divided into two sections by a pivotally hinged coarse filter 37 depending downwardly from the upper end of the body. The filter 37 is located across the body 13 so that it divides the vessel into a rear section and a front section. The tube 28 is connected to the opening 26 in the rear section of the vessel 14 and a valve flap 38 is mounted at the opening 26 and can only be displaced to the position shown in FIG. 1 by the action of the suction flow developed within the collecting vessel 14. In the front section of the vessel 14, air deflectors 39 are arranged in spaced relation from the coarse filter 37 and deflectors 39 define a suction duct opening to the suction part of the blower 17. When the blower is operated the arrows in the vessel 14 indicate the suction action drawing the air through the vessel toward the blower 17. Within the front space in the collecting vessel, a fine filter 41 is provided for the flow through the vessel after it leaves the coarse filter and commences its flow toward the blower 17.

In the upper part of the body 13, the blower space 15 has an outlet opening 42 for diverting air from the suction flow generated by the blower 17. This diverted flow of air is returned through the air duct 22 and the downwardly extending tube 27 to the whirl-suction head 30 located behind the rear end of the body 13. The principle part of the suction air drawn through the whirl-suction head and flowing in the upwardly extending tube 28 is directed to the cyclone separator 18 by way of the air duct 19. Due to the cyclonic action within the separator 18, the cleaned air is transferred to the atmosphere via the air ducts 20,21 with the air exiting through an air outlet opening 43 from the duct 21. The air carrying any dirt and refuse separated out in the separator is fed back into the lower part of the vessel 14 through another air duct 23. The whirl-suction head 30 which acts as the pick-up device will now be described in detail with the aid of FIGS. 2, 3 and 4.

Figure 2:
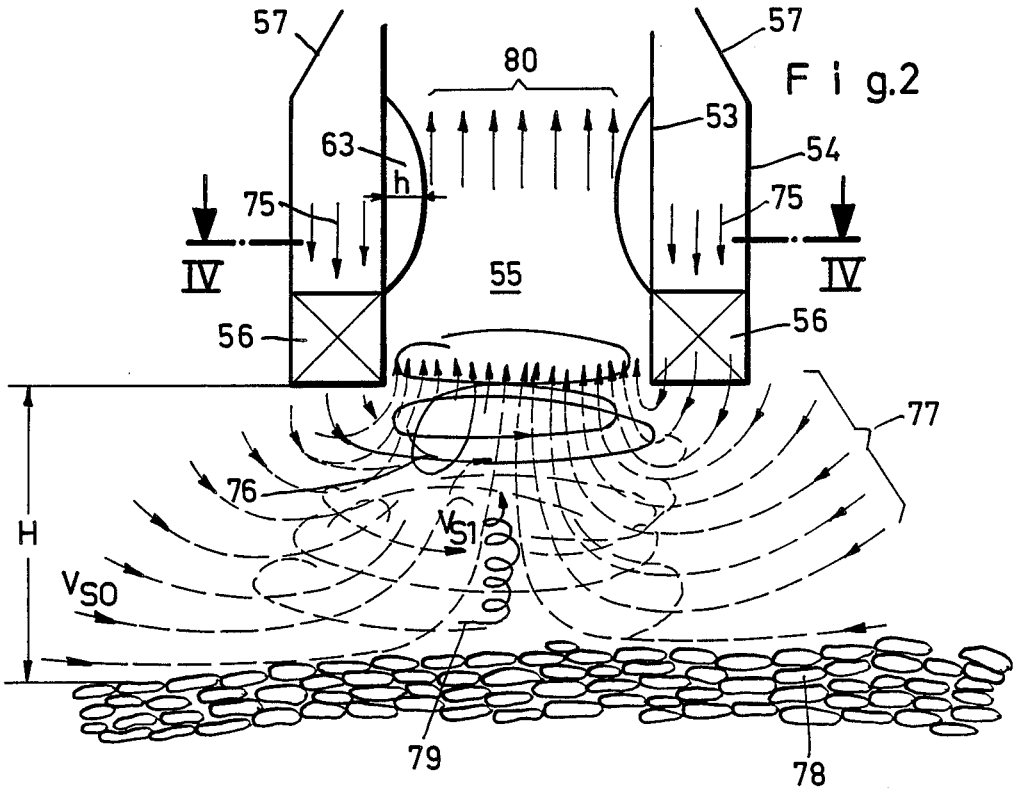
FIG. 2 is a cross-sectional view on a enlarged scale of a picking-up device shown in FIG. 1 with the device including a head for providing a whirling flow and a suction flow.

At its lower end the circular whirl-suction head 30 has two openings 50,51 with the opening 50 centered within the annular opening 51 and both openings located in the same plane. Air is drawn in through the opening 50 and the return air flowing through the duct 22 and the tube 27 is blown out through the opening 51 for generating a whirling action which will be described later. Further, as shown in FIG. 2, the head includes a central pipe section 53 forming the opening 50 at its lower end with a radially outer second pipe section 54 constructed in the manner of a forked pipe and the space between the exterior of the central pipe section 53 and the interior of the second pipe section 54 opens downwardly to the opening 51. The flow space formed between the two pipe sections is coaxial relative to the central pipe section 53. A pipe half 57 is located at the upper portion of the second pipe section 54, note FIG. 2 and converges inwardly forming a diffuser. The angle of the pipe half 57 is less than 7° and the diffuser affords a low-turbulence air current passing downwardly into the space limited outwardly by the second pipe section 54.

Figure 3:
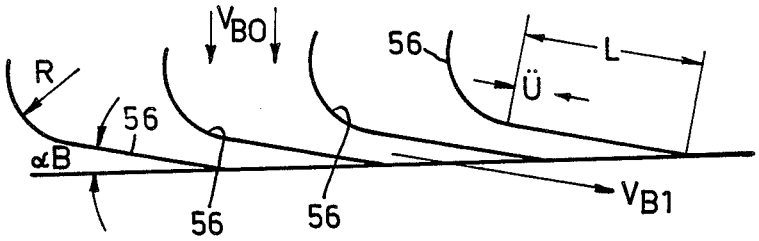
FIG. 3 is a detail view of a part of the device illustrated in FIG. 2.
Figure 4:
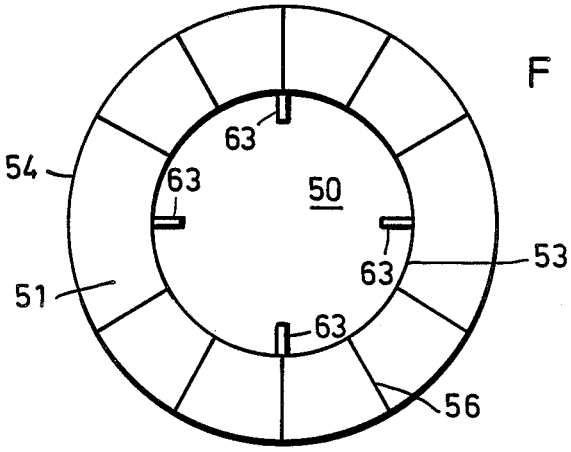
FIG. 4 is a sectional view taken along the line IV—IV in FIG. 2.
Figure 8:
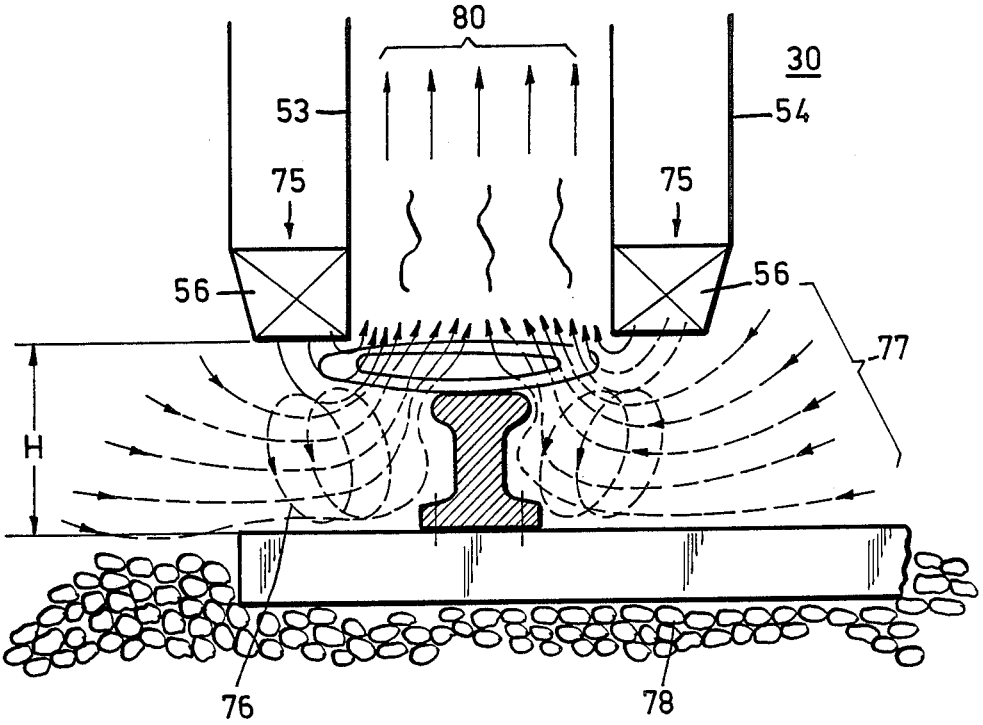
FIG. 8 is a view of the apparatus illustrated in FIG. 2 located above a rail of a railroad track.

At least six but preferably twelve vanes or blades 56 are located in the annular space between the central pipe section 53 and the outer second pipe section 54, note FIG. 4. The vanes 56, shown in more detail in FIG. 3, are arranged in the lower end of the space between the second pipe section 54 and the central pipe section 53 in the manner of a ring so that the air returned from the blower space 15 experiences a circular whirling current about the central axis of the head 30. As can be seen in FIG. 3, the vanes 56 are bent from the vertical through a curved section into a straight section 56' with an angle of inclinationl $\alpha_{62}$ relative to the horizontal line defined by the openings 50,51. The angle of inclination $\alpha_{62}$ relative to the horizontal is in the range of approximately 8° to 15° and preferably 10° to 13°. As can be seen the straight sections 56' of each vane overlaps the adjacent vane by a dimension / and the range of the overlap is 0 to 25% and preferably 10 to 15% of the overall length L of the straight section 56' of the vanes 56. The radius R of the curved sections of the vanes is in the range of 30 to 60%, preferably 35 to 40%, of the length L of the straight sections 56'. The straight sections 56' of the vanes can be skewed in themselves. The diameter of the opening 50 from the central pipe section 53 is approximately 250 to 300 mm, preferably 250 mm while the diameter of the second pipe section 54 is approximately 400 to 500 mm, and preferably 400 mm. The transition or inclination angle at the upper end of the second pipe section is selected in such a way that the return air flowing from the tube 27 is guided into a calm air current, that is, any abrupt transitions within the various parts conducting the return air flow are avoided.

Accordingly, as indicated above, the central pipe section 53 forms a suction nozzle, while the second pipe section 54 coaxially to the pipe section 53 forms a whirl nozzle. The upper ends of the pipe sections 53,54 spaced upwardly from the openings 50,51 have connecting flanges 59,58, not shown in detail, note FIG. 1, which securely connect the lower pipe sections to the ends of the tubes 28 and 27. An adjustable throttle 60 is located in the tube 27 directing the downward flow of the return air and the throttle is spaced from the vanes 56 to assure a low-turbulence current. Further, it is also advisable to still the suction current in the central pipe section 53. To provide this stilling action a plurality of rectifier plates 63 of approximately 250 mm in length and with a maximum height or inward projection of approximately 60 mm are used, note FIG. 2 and FIG. 4. The plates 63 are spaced about 90° apart around the interior of the central pipe section 53 and extend radially inwardly.

The above described apparatus functions in the following manner:

A portion of the suction air flow produced by the blower 17, as mentioned above, is bled through the outlet opening 42 into the air duct 22. This air is returned downwardly through the tube 27 and is directed through the whirl nozzle 54 passing out of the opening 51. This positive flow of air streams along at a low velocity $V_{BO}$ in the direction of the arrows 75 and flows over the vanes 56 where the air flow is deflected, accelerated to a substantially higher velocity $V_{B1}$ so that the air forms the driving whirl ring 76, note FIG. 2. The whirl ring 76 flows in a circular path beneath the opening 51 and is at the same time exposed to the suction action acting within the central pipe section 53 through the opening 50. The driving whirl ring or air flow 76 draws an additional air flow 77 inwardly from the surrounding atmosphere so that it flows at a velocity of $V_{SO}$ which initially is low and due to the friction and momentum of the whirling air flow 76, it commences rotating slowly at first and then more strongly toward the inside or axis of the head 30 with the increasing velocity $V_{S1}$. The lowest layer of this air flow moving over the ballast bed or the ground 78 moves substantially more slowly because of the existing friction which prevails. However, because of the rotational action of the air flow a greater radial velocity is developed inwardly toward the center 79 of the whirling air flow located below the opening 50. The combination of the air flow passing out of the opening 51 and the air flow drawn in from the surrounding atmosphere forms a combined flow 80 drawn into the central pipe section 53 exposed to the suction action developed by the blower 17. The air flowing in through the opening 50 and upwardly through the pipe section 53 has a rotational component which is entirely or partly eliminated by the rectifier plates 63.

Figure 5:
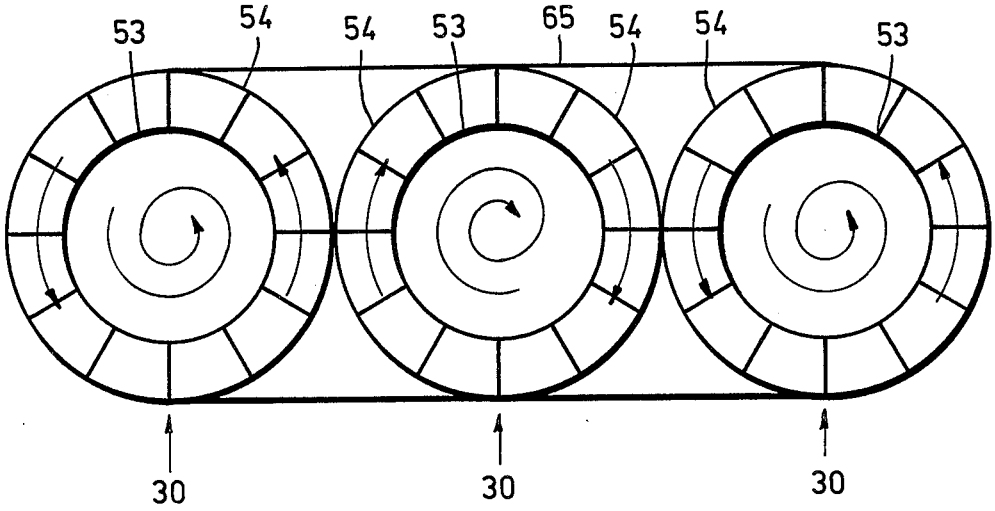
FIG. 5 is a plan view of an embodiment including a plurality of the picking-up devices shown in FIG. 2 and with the devices being adjacent to one another.

In FIG. 5 three whirl suction heads 30 are shown arranged side by side with the flow in adjacent heads arranged in opposite directions for generating the whirling air flows. The heads act in the same manner and are constructed in the same way as shown in FIG. 2 and are enclosed in a common housing 65 acting as a boundary around the heads.

Figure 6:
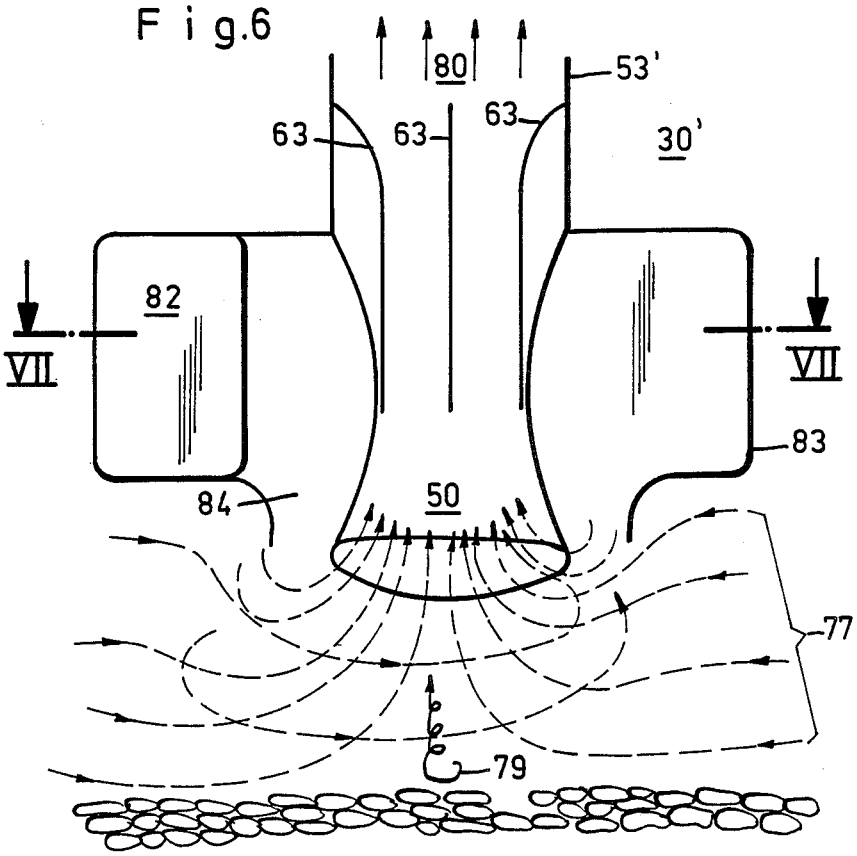
FIG. 6 is a cross-sectional view of a second embodiment of the picking-up device embodying the present invention.
Figure 7:
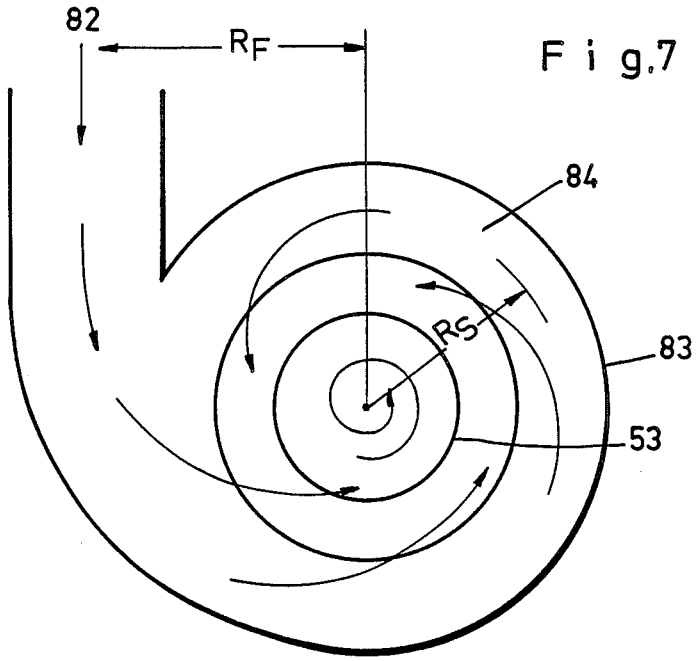
FIG. 7 is a sectional view taken along the line VII—VII in FIG. 6.

FIG. 6 displays a second embodiment of a whirl-suction head 30' which has a tangentially directed blowing air passage 82 constructed in the manner of a spiral 83, note FIG. 7, with the spiralling air flow exiting through the annular space 84. The annular space 84 is free of any vanes. The air flow from the annular space or opening 84 rotates as a ring vortex and after passing downwardly out of the opening 84 is drawn into the central pipe section 53' which converges inwardly from the opening 50 and then expands outwardly. In the embodiment of FIG. 6 the central pipe section 53' is provided with the rectifier plates 63' which are located in the widening portion of the central pipe section, note also FIG. 7. The flow spiral 83 circles around the central pipe section 53'. At the annular outlet 84 the air flow has a lower velocity than the peripheral velocity in the annular outlet 84 in the ratio of the radius $R_S$ the mean radius of the annular opening 84, and the radius of $R_F$ the mean radius of the air passage 82.

According to a preferred embodiment of the invention, a whirl-suction head 3, as shown in FIG. 2, sucks approximately 1.25 $m^3/s$ air into the central pipe section 53 of 250 mm diameter with $\frac{2}{3}$ of the air being drawn in from the surrounding atmosphere and approximately $\frac{1}{3}$ of the air representing the return flow through the tube 27 from the lower space 15. The positive air flow out of the opening 51 has an outside diameter of approximately 400 mm and flows at approximately 5 m/s axially relative to the guide vanes between which it is accelerated to a discharge velocity of $V_{B1}=20$ m/s. The angle $\alpha_{62}$ of the straight sections 56' of the vanes 56 with the horizontal is 12°. The height H above the ballast bed 78 to the openings 50,51 is approximately 200 mm, and the radial component of the suction flow beneath the air flow vortex 76 is approximately 6 m/s at a distance of approximately 75 mm from the surface of the ballast bed. The rotating velocity in the same plane is approximately 16 m/s. The resulting air flow velocity is approximately 17 m/s. In the lowest layer of the air flow over the ground surface or over the ballast bed, the rotating velocity of the air flow is approximately 10 m/s, however, the radial velocity is approximately 12 m/s with a resulting total velocity of approximately 15.4 m/s. This air flow carries away all dirt and refuse from the ballast bed, particularly the dirt and refuse typical of the railroad station area, when the vehicle 10 carrying the refuse pick up apparatus, drives forwardly at a speed of approximately 0.5 to 0.7 m/s. It is particularly advantageous if the easily soiled recirculating positive air flow is completely sucked in along with its refuse residue so that dust does not return to the surrounding atmosphere. In the cyclone separator 18 having a diameter of approximately 600 mm and a height of approximately 1500 mm, the exhaust air of approximately four whirl-suction heads 30 of the type shown in FIG. 2 can be almost completely cleaned to a pressure loss of 250 mm WS with the maximum grain size of the dirt or dust being approximately 3 to 4 mm. The vacuum required to affect a suction downstream of the blower 17 is approximately 350 mm WS, thus the total drop in pressure is approximately 600 mm WS so that when employing the four whirl suction heads mentioned above with an air-throughput of 1.25 $m^3/s$, that is, a total air-throughput of approximately 5 $m^3/s$, requires a net output of around 30 KW and, with an efficiency factor $\eta_{Gebl \approx 0.6}$ requires a gross drive output of approximately 50 KW.

With the four rectifier plates 63, note FIG. 4, having a height of approximately 250 mm and having a maximum inwardly directed dimension h of 60 mm from the inside surface of the central pipe section 53, the pressure loss in the suction line can be reduced by approximately 80 mm WS after an extensive interruption of the jet flow, so that the total pressure loss drops to 520 mm WS, accordingly, the blower output drops to approximately 43 KW. Of course, this saving can be compensated again by a larger air quantity for improving the cleaning effect and the dirt or dust grain size removed by the cyclone separator. A factor to be considered is that if the air flow is too large,then too many tin cans may be sucked up from the ballast bed, since two or three of such cans could block the rectifier plates in certain situations. To avoid such a situation, the problem posed by the pick-up of too many cans could be avoided by dispensing with the rectifier plates.

These embodiments apply in a corresponding manner when the pick-up apparatus, as described above, is used for cleaning almost level areas or surfaces such as a road surface.

While specific embodiments of the invention have been shown and described in detail to illustrate the application of the inventive principles, it will be understood that the invention may be embodied otherwise without departing from such principles.

We claim:

1. Apparatus for picking up refuse from a surface, such as the ballast bed of a railroad track, comprising: a wheeled vehicle, means located on said vehicle for genera a flow of air, first duct means in said vehicle having a first end and a second end with the first end positioned adjacent said means for generating a flow of air for providing a suction action within said first duct means and the second end forming a suction port positioned above the surface to be cleaned, second duct means within said vehicle having a first end and a second end with said first end arranged to receive a flow of air from said means for generating a flow of air and said second end located at the second end of said first duct means, guide means in the second end of said second duct means for directing the air flow out of said second duct means in a downwardly directed circular flow path around a downward projection of said suction port so that the circular flow path of the air sweeps over the surface to be cleaned and refuse swept up by the flow of air is drawn inwardly and upwardly by the suction action within said first duct means flowing through said suction port.

2. Apparatus, as set forth in claim 1, including a plurality of said first and second duct means forming a plurality of suction ports with said second end of each of said second means forming a downwardly directed circular flow path around each of said suction ports, said suction ports disposed in laterally spaced relation, a common housing laterally enclosing said first and second duct means at the second ends thereof, and said housing spaced outwardly from said suction port and connected to said vehicle.

3. Apparatus, as set forth in claim 1, wherein a closed body is mounted on said vehicle, walls within said closed body defining a blower space, said means for generating a flow of air comprising a blower located within said blower space, an opening from said blower space connected to said first end of said second duct means for returning a portion of the air drawn through said first duct means by said blower into said second duct means.

4. Apparatus, as set forth in claim 1, wherein said first duct means comprises a first pipe section forming said suction port, said second duct means includes a second pipe portion encircling said first pipe section and spaced radially outwardly from said first pipe section forming therebetween an annular space, said guide means comprising a ring of vanes located within said annular space for directing the air flowing through said second duct means in a downwardly directed circular flow path, said vanes each having a curved upstream section relative to the air flow through said second duct means and a downstream straight section, and each said downstream straight section overlapping the downstream straight section of an adjacent said vane with the downstream ends of said downstream straight sections located at the second end of said first duct means.

5. Apparatus, as set forth in claim 4, wherein said downstream straight sections form an angle with the horizontal in the range of approximately 8° to 15°.

6. Apparatus, as set forth in claim 5, wherein said downstream straight sections form an angle with the horizontal in the range of 10° to 13°.

7. Apparatus, as set forth in claim 4, wherein the overlap of adjacent downstream straight sections is in the range of 0 to 25% of the total length of said downstream straight sections.

8. Apparatus, as set forth in claim 7, wherein the overlap of adjacent said downstream straight sections is in the range of 10 to 15%.

9. Apparatus, as set forth in claim 4, wherein the radius of the upstream curved section of said vanes is in the range of 30 to 60% of the overall length of said downstream straight section of said vanes.

10. Apparatus, as set forth in claim 9, wherein the radius of said upstream curved sections of said vanes is in the range of 35 to 45% of the length of said downstream straight sections.

11. Apparatus, as set forth in claim 4, wherein said second duct means comprises a first duct section extending from the first end of said second duct means, a tubular section forming the second end of said second duct means and extending therefrom toward said first end, and a bifurcated pipe section connecting said first section and said second, section of said second duct means, said first section having a smaller diameter than said second section and said forked section forming a diffuser.

12. Apparatus, as set forth in claim 11, wherein the angle of said forked section relative to the central axis of said second section is less than 7°.

13. Apparatus, as set forth in claim 1, wherein an axially extending pipe section forms said suction port, said pipe section having rectifier plates extending radially inwardly from the inside surface of said pipe section for providing a stilling effect to air passing upwardly through said suction port into said pipe section.

14. Apparatus, as set forth in claim 1, wherein said first duct means includes an inner axially extending pipe section forming the second end of said first means, said second duct means includes an outer pipe section forming the second end of said second duct means and extending concentrically around said inner pipe section, said inner pipe section having a diameter of approximately 250 to 300 mm, and said outer pipe section having a diameter of approximately 400 to 500 mm.

15. Apparatus, as set forth in claim 14, wherein said inner pipe section having a diameter of 250 mm and said outer pipe section having a diameter of 400 mm.

16. Apparatus, as set forth in claim 1, wherein said second opening of said first duct means and said second opening of said second duct means are located in the same generally horizontal plane and said plane is located approximately 180 mm above the surface to be cleaned.

17. Apparatus, for picking up refuse from a surface, such as the ballast bed of a railroad track, comprising a wheeled vehicle, means mounted on said vehicle for creating a flow of air, means for picking up refuse including a suction opening spaced upwardly from the surface to be cleaned and a collecting chamber in flow communication with said suction opening for receiving the refuse passing through the suction opening, wherein said means for picking up refuse comprises a suction pipe forming said suction opening, a spiral member encircling said suction pipe and arranged to receive a flow of air for blowing air outwardly and downwardly around the projection of said suction opening, said spiral having an outlet for directing the flow of air downwardly around a downward projection of said suction opening, said outlet from said spiral having an annular configuration, and the mean radius of said annular outlet being smaller than the mean radius of said spiral.

18. Apparatus, as set forth in claim 17, wherein said pipe section forming the suction opening converges inwardly from the suction opening and then diverges outwardly in the direction away from the suction opening.

19. Apparatus, as set forth in claim 18, wherein said pipe section forming said suction opening includes stabilizing rectifier plates located therein in the part of said pipe section diverging outwardly spaced from said suction opening.

20. Apparatus, as set forth in claim 1, wherein said vehicle includes wheels for traveling over a conventional road surface and rollers for traveling over rails.

21. Apparatus, as set froth in claim 17, wherein said vehicle includes wheels for traveling over a conventional road surface and rollers for traveling over rails.

* * * * *